United States Patent [19]

Matsuura et al.

[11] Patent Number: 4,576,251

[45] Date of Patent: Mar. 18, 1986

[54] FOLDING SCAFFOLD

[76] Inventors: Masahiro Matsuura, 19-21, Toyono-cho; Eiichi Aikawa, 16-10, Ikedahigashimachi, both of Neyagawa-shi, Osaka, Japan

[21] Appl. No.: 755,143

[22] Filed: Jul. 15, 1985

[51] Int. Cl.[4] ..... E04G 1/34

[52] U.S. Cl. ..... 182/152; 182/155; 182/118

[58] Field of Search ..... 182/152, 155, 118, 119, 182/225; 108/130, 131

[56] References Cited

U.S. PATENT DOCUMENTS

| | | | |
|---|---|---|---|
| 337,988 | 3/1886 | Palmer | 182/118 |
| 472,406 | 4/1892 | Smith | 182/118 |
| 925,598 | 6/1909 | Reutfrow | 182/118 |
| 2,062,473 | 12/1936 | Norton | 182/152 |
| 2,593,386 | 4/1952 | Dirks | 182/152 |
| 3,128,842 | 4/1964 | Satrum | 182/152 |
| 3,493,079 | 2/1970 | Dudschus | 182/152 |
| 3,739,876 | 6/1973 | Goldberg | 182/155 |
| 4,046,221 | 9/1977 | Edenfield | 182/155 |

FOREIGN PATENT DOCUMENTS

| | | | |
|---|---|---|---|
| 2119218 | 11/1972 | Fed. Rep. of Germany | 182/118 |

*Primary Examiner*—Reinaldo P. Machado

*Attorney, Agent, or Firm*—Wenderoth, Lind & Ponack

[57] ABSTRACT

An improved scaffold is proposed which can be easily assembled, and folded. It comprises a scaffold plate, a pair of ladders, hook members each secured to the scaffold plate, and holder members each pivotally mounted on the hook members. The hook members are adapted to receive one of the crossbars on the ladder and to support the holder members.

1 Claim, 7 Drawing Figures

FOLDING SCAFFOLD

The present invention relates to a folding scaffold for use in various works.

Portable scaffolds of various structure have been used. But, conventional scaffolds are complicated in construction, heavy in weight and troublesome to assemble and fold. They are inconvenient for transit and require trouble for height adjustment. Also, they were unstable for use on oblique surfaces.

An object of the present invention is to provide a scaffold which obviates the abovesaid shortcomings and which can be easily assembled and folded and permits easy adjustment of height and which can be used stably even on oblique surfaces.

In accordance with the present invention, the ladders are held by the holders each pivotally mounted at each end of the scaffold plate so as to be movable longitudinally. The hook member secured to the scaffold plate is adapted to receive the crossbar of the ladder and support the holder and the ladder held by the holder. This arrangement ensures that the ladders are securely coupled to the scaffold plate without play.

Other objects and advantages will become apparent from the following description taken with reference to the accompanying drawings, in which.

Figure 1:
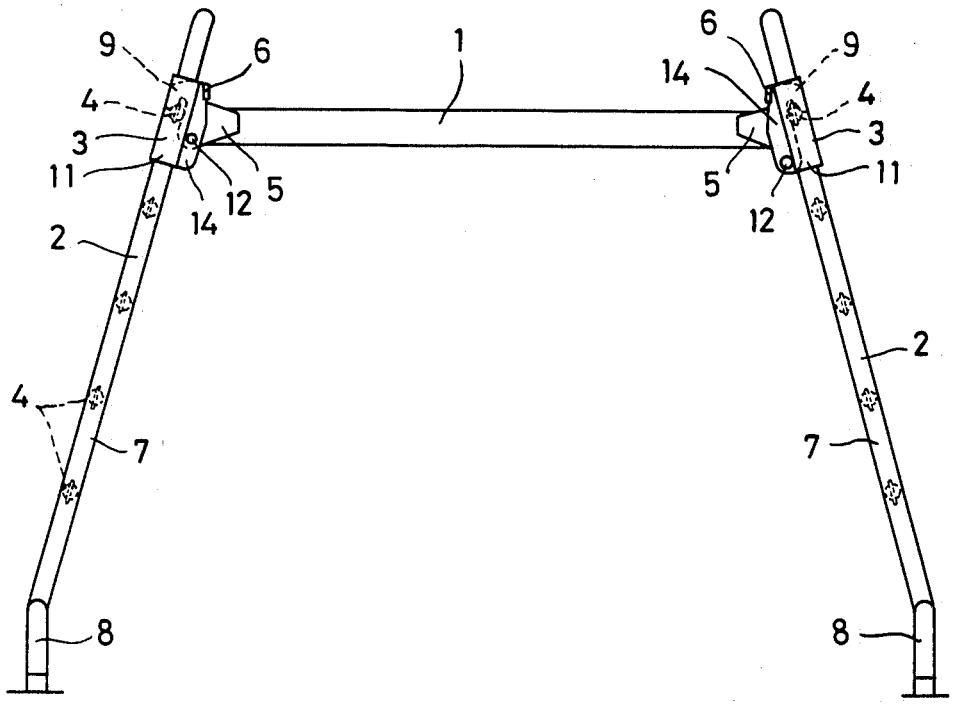
FIG. 1 is a front view of the scaffold embodying the present invention in use.

Referring to the drawings, the scaffold according to the present invention comprises a scaffold plate 1, a pair of ladders 2 one disposed at each side of the scaffold plate, holders 3 each pivotally mounted on the scaffold plate 1 for holding the ladder 2 so as to be axially adjustable, and hook members 5 each secured to the scaffold plate 1 for supporting one crossbar 4 of the ladder 2. On the hook member 5, a support 6 for the holder is formed.

The ladder 2 has a plurality of crossbars 4 arranged between a pair of vertical poles 7 at regular intervals, and legs 8 at bottom of the vertical poles.

The hook members 5 are secured as by welding to each end of the scaffold plate 1 and its outwardly projecting end is formed into the shape of a hook 9 which has a notch 10 at its lower side to receive one of the crossbars 4 of the ladder 2.

Figure 3:
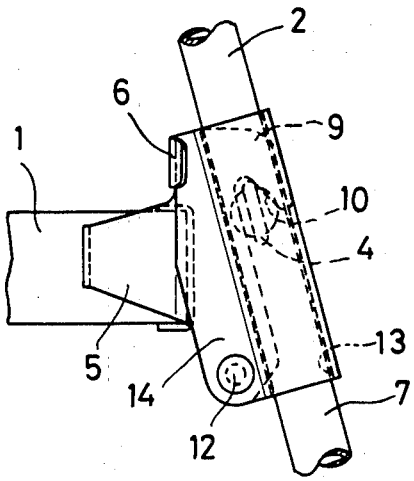
FIG. 3 is an enlarged front view of the joint part at the righthand side in FIG. 1.
Figure 4:
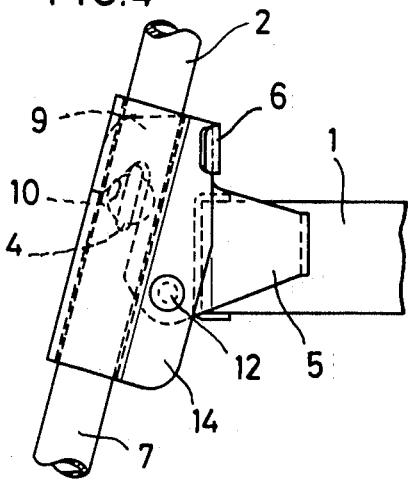
FIG. 4 is an enlarged front view of the joint part at the lefthand side in FIG. 1.
Figure 5:
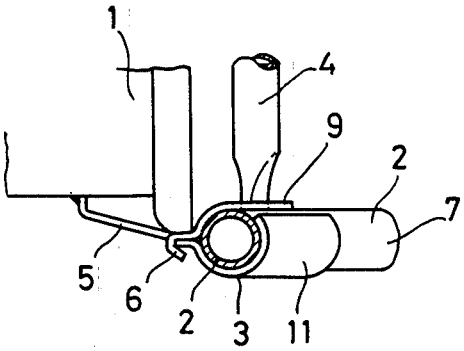
FIG. 5 is a horizontal sectional plan view of the joint part.
Figure 6:
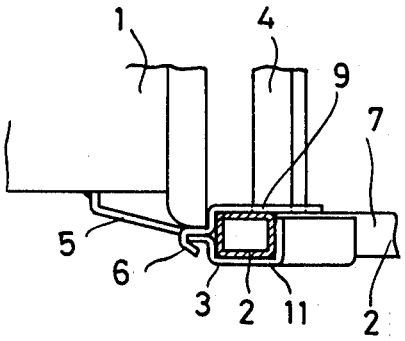
FIG. 6 is a view similar to FIG. 5 of another embodiment.
Figure 7:
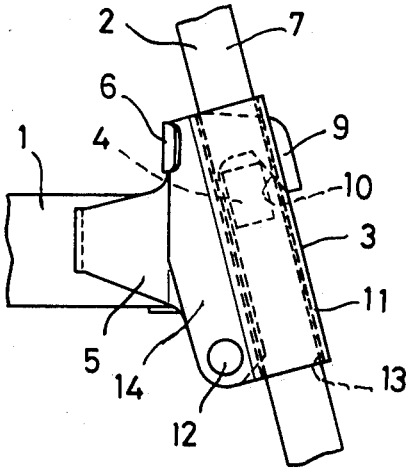
FIG. 7 is a view similar to FIG. 3 of the embodiment shown in FIG. 6.

As shown in FIGS. 5 and 6, the hook 9 bends inwardly so as to embrace the inner side of the vertical pole 7. As shown in FIGS. 3, 4 and 7, the notch 10 has its outer edge tapering toward the scaffold plate 1. Thus, as the crossbar 4 gets into the notch 10, the ladder 2 is pulled toward the scaffold plate 1.

The holder 3 has a base plate 14 from one side of which a holding portion 11 extends so as to embrace the outer side of the pole 7. With its base plate 14 mounted on the hook member 5, the holder 3 is pivoted to the hook member 5 at a position below the hook 9.

The holder 3 is pivotable around the shaft 12 and its holding portion 11 embraces the pole 7 so as to allow it to move up and down. The ladder 2 is pivotable together with the holder 3.

When the ladder 2 supported by a pair of the holders 3 is pushed up to its erect position, one of the crossbar 4 on the ladder will get into the notch 10 formed in the hook 9. Under the load of the scaffold plate 1, the crossbar 4 is urged toward the plate 1 and some torque produces to tilt the ladder 2 inwardly around the shaft 12.

The hook member 5 is formed with a support 6 on its inner vertical edge to support the upper portion of the base plate 14 of the holder 3 to prevent it from tilting further.

The ladder 2 is held at two points, i.e. by the engagement of its crossbar into the notch 10 and the engagement of the pole 7 against the holding portion 11 at point 13. Now the ladder 2 is secured with respect to the scaffold plate 1 without play.

Figure 2:
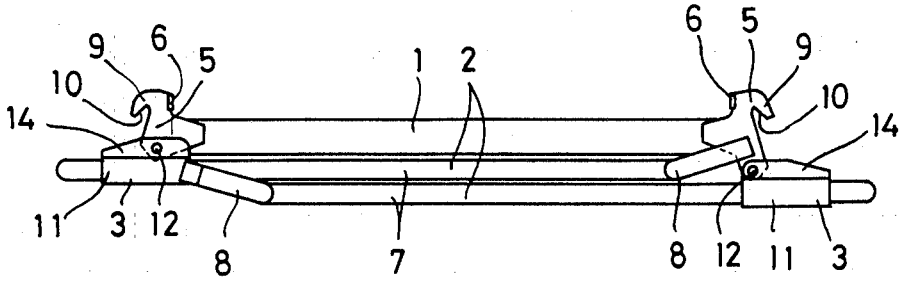
FIG. 2 is a front view of the same in a folded state.

FIG. 1 shows the scaffold with the ladder 2 erected. When the pair of ladders 2 are folded under the scaffold plate 1, as shown in FIG. 2, the ladders overlap snugly one upon another.

FIG. 3 shows the hook member 5 and the holder 3 disposed at the righthand side of FIG. 1, and FIG. 4 shows the same disposed at the lefthand side. The shaft 12 at righthand side of FIG. 1 is below the shaft 12 at lefthand side.

The embodiment shown in FIG. 1–5 uses round pipes for the ladder 2. Each end of the crossbar 4 is made flat to be coupled to the poles 7. The holding portion of each holder 3 is shaped to be arcuate.

The embodiment shown in FIG. 6 and 7 uses square pipes instead of round pipes. The holding portion of the holder 3 is in the shape of so as to embrace the square pipe. The hook 9 has a wide opening to receive the square crossbar.

The ladder 2 may use pipes of any other section such as semi-circular and H-shape.

The components of the scaffold of the present invention may be made of any desired material. But they should preferably be made of aluminum to make the entire scaffold lightweight.

In use, the ladder 2 is inserted into the holders 3 mounted on the scaffold plate 1 at its each end, and is pivoted around the shaft 12 to erect it. It is then slid upwardly along the holding portion 11 until the crossbar 4 at a desired height engages in the notches 10 in the hooks 9. Now the ladders 2 are self-supported in such a position as shown in FIG. 1, so that a man can work on the scaffold plate 1. As described above, the ladders 2 are coupled to the scaffold plate 1 without any play.

When the scaffold is stored, the ladders 2 are pulled down to disengage the crossbars 4 from the hooks 9. They are then folded by pivoting around the shaft 12 until they overlap one upon another as shown in FIG. 2.

The height of the scaffold plate 1 can be freely adjusted by selecting the crossbar 4 to be engaged in the hook 9. When the scaffold is used on an oblique surface, the crossbars 4 at different heights may be engaged in the hooks 9 on the ladders 2.

The ladders 2 can be used as ladders by removing from the holders 3.

The present invention has the following other advantages:

(1) Since one of the crossbars of the ladder is received in the notch formed in the hook member secured to the scaffold plate and the poles of the ladder are supported by the holders pivotally mounted on the hook member, the ladders can be coupled to the scaffold plate without play.

(2) The load on the scaffold plate effectively acts to make more secure the engagement of the ladder poles with the holders, thus helping to make the scaffold safer to use.

(3) Since the ladders can be removed from the scaffold plate, scaffolds with different heights and lengths can be assembled by preparing ladders and scaffold plates of different sizes.

What I claim:

1. A scaffold comprising:

a scaffold plate;

a pair of ladders each having a plurality of crossbars and mounted at each end of said scaffold plate;

hook members each secured to each corner of said scaffold plate; and holder members each pivotally mounted on said respective hook members for holding said ladder;

said hook members each formed with a notch to receive one of the crossbars on said ladder and having a means for holding said holder member to limit the tilting of said holder member toward said scaffold plate.

* * * * *